US007185443B2

(12) United States Patent
Penhale

(10) Patent No.: US 7,185,443 B2
(45) Date of Patent: Mar. 6, 2007

(54) SPACER

(75) Inventor: Gary H. Penhale, Bessemer, MI (US)

(73) Assignee: Extreme Tool & Engineering, Inc., Wakefield, MI (US)

( * ) Notice: Subject to any disclaimer, the term of this patent is extended or adjusted under 35 U.S.C. 154(b) by 157 days.

(21) Appl. No.: 10/962,806

(22) Filed: Oct. 8, 2004

(65) Prior Publication Data

US 2005/0188646 A1 Sep. 1, 2005

Related U.S. Application Data

(60) Provisional application No. 60/510,005, filed on Oct. 9, 2003.

(51) Int. Cl.
*G01D 21/00* (2006.01)
*E04D 1/34* (2006.01)

(52) U.S. Cl. ..... 33/649

(58) Field of Classification Search ..... 33/649, 33/646, 647, 648

See application file for complete search history.

(56) References Cited

U.S. PATENT DOCUMENTS 2,511,083 A 6/1950 Small
3,222,831 A 12/1965 Pritchard
4,089,141 A 5/1978 Heroux
4,159,029 A 6/1979 Matthews
4,164,346 A 8/1979 Sickler
4,314,429 A 2/1982 Casteel
4,698,942 A 10/1987 Swartz
4,899,459 A 2/1990 Taggart
D318,608 S 7/1991 Schenker
5,505,034 A * 4/1996 Dueck ..... 52/604
5,564,245 A 10/1996 Rademacher
5,622,020 A 4/1997 Wood
5,794,384 A 8/1998 Dean
D451,787 S 12/2001 Taft
6,367,160 B1 4/2002 Rempe
6,494,016 B1 12/2002 Bankson

* cited by examiner

*Primary Examiner*—Christopher W. Fulton
(74) *Attorney, Agent, or Firm*—Barnes & Thornburg LLP

(57) ABSTRACT

A spacer for facilitating hanging and fastening siding strips to a structure. The spacer is placed on a previously-fastened siding strip. An unfastened siding strip is then placed on the spacer, allowing the unfastened siding strip to be fastened. Once fastened, a portion of the spacer may be separated allowing the siding strips to come into unobstructed contact with one another.

26 Claims, 3 Drawing Sheets

SPACER

RELATED APPLICATIONS

The present application is related to and claims priority to U.S. Provisional Patent Application, Ser. No. 60/510,005, filed on Oct. 9, 2003, entitled SPACER FOR FIBER CEMENT SIDING. The subject matter disclosed in that provisional application is hereby expressly incorporated into the present application.

TECHNICAL FIELD

The present invention relates generally to a spacer for hanging and positioning siding.

BACKGROUND AND SUMMARY

Apparatus for hanging and fastening siding panels are known. These apparatus allow siding panels to be positioned in an overlapping fashion and fastened to a structure, such as a house. These apparatus, however, are either cumbersome or allow gaps to exist between overlapping siding panels. The existing gaps allow wind between the siding panels, which can pull fastened siding panels off of a structure. The gaps also allow foreign objects to get between the siding panels, which can damage the siding panels, as well as the structure to which the siding panels are attached.

The present invention is a spacer for hanging and positioning siding panels for fastening to a structure. Siding panels made of fiber cement are commonly used, and are used as an example throughout for illustrative purposes only. Comparable types of siding made of other materials may also be used in conjunction with this invention.

One embodiment of a spacer for hanging and positioning siding serves several purposes. The spacer will allow siding to be installed with the efforts of only one person, reducing the expenses associated with installing, for example, fiber cement siding. The spacer will also allow for the fiber cement siding to have a more aesthetically pleasing appearance by allowing the visible portion of the spacer to be removed after installation. The spacer will also allow one fiber cement siding panel to be in contact with an adjacent fiber cement siding panel, reducing the potential for winds to pull a fiber cement siding panel away from its attached structure.

One embodiment of the spacer is made of plastic. This embodiment allows one or more spacers to be attached to a first fiber cement siding panel. The configuration of this embodiment allows a second fiber cement siding panel to be positioned onto the spacer(s), with the spacer(s) attached to the first fiber cement siding panel. This allows for the second fiber cement siding panel to be attached to a structure being sided, while being supported by the spacer(s). After the second fiber cement siding panel is attached to a desired structure, this embodiment allows for the spacer(s) to be mostly removed such that any remaining portions of the spacer(s) are unseen when the outside of the fiber cement siding panels is viewed. This embodiment of the spacer allows the first fiber cement siding panel to be in contact with the second fiber cement siding panel due to the portions of the spacer(s) being removed.

Another embodiment of the spacer has a support piece attached to a top piece. The top piece has a ridge extending from it. The support piece, top piece, and ridge are configured to form a hook. The hook of this embodiment allows the spacer to attach to a first fiber cement siding panel, with the first fiber cement siding panel having been previously attached to a structure being sided. The spacer has a break point located along the top piece, allowing for the removability of a portion of the spacer. The support piece of this embodiment also has a shelf piece extending from it in a direction opposite that which the top piece extends. This embodiment of the spacer also has a brace connected to the support piece and the shelf piece, further supporting the position of the shelf piece. The shelf piece has a ridge extending from it.

When this embodiment of the spacer is attached to the first fiber cement siding panel, the spacer is in position to allow a second fiber cement siding panel to be placed onto the shelf piece of the spacer. The ridge extending from the shelf piece is positioned at a distance from the support piece to allow the second fiber cement siding panel to fit onto the shelf piece between the ridge and the support piece. The ridge extends far enough from the shelf piece to keep the second fiber cement siding panel from sliding off of the shelf piece. While positioned on the shelf piece, the second fiber cement siding panel can be attached to the structure being sided. Upon attachment of the second fiber cement siding panel, this embodiment allows for the removal of a portion of the spacer. In this embodiment, the shelf piece extends beyond the ridge extending from the shelf piece such that the portion of the shelf piece extending past the ridge may be struck with an object, such as a hammer, for example, causing the spacer to separate at the break point. This allows for a portion of the spacer to be removed. Only the ridge extending from the top piece and a portion of the top piece will not be removed, and will remain on the first fiber cement siding panel. When the shelf piece is struck, the removable portion will fall from behind the second fiber cement siding panel such that the remaining portion will be unseen due to the configuration of the fiber cement siding panels. With the portion of the spacer removed, the second fiber cement siding panel is in contact with the first fiber cement siding panel such that there is at least one point of contact between them.

It is appreciated that at least two spacers per fiber cement siding panel can be used, depending on the length of the cement fiber siding panels, allowing one individual to install the fiber cement siding. The spacers may be positioned along a fiber cement siding panel such that when another fiber cement siding panel is placed onto the shelf pieces of the spacers, the fiber cement siding panel placed onto the spacers is secure from tipping at either end.

Additional features and advantages of the spacer will become apparent to those skilled in the art upon consideration of the following detailed description of the illustrated embodiment exemplifying the best mode of carrying out the invention as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the invention, and such exemplification is not to be construed as limiting the scope of the invention in any manner.

DETAILED DESCRIPTION OF THE DRAWINGS

Figure 1:
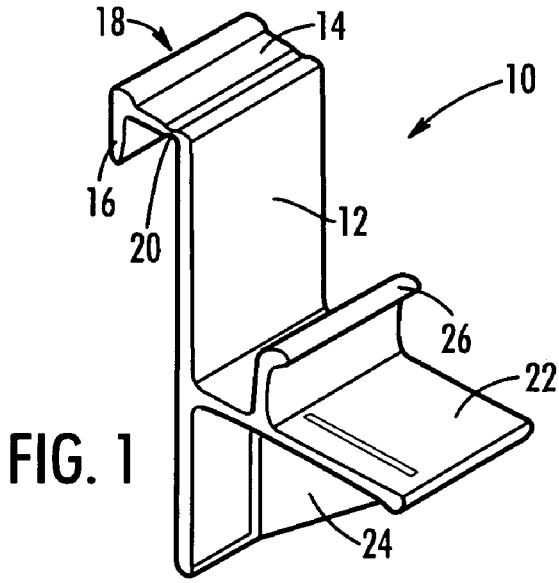
FIG. 1 is a perspective view of an illustrative embodiment of a spacer.

A perspective view of an illustrative embodiment of a spacer 10 is shown in FIG. 1. Spacer 10 is formed of plastic in this embodiment. However, it is appreciated that spacer 10 may be formed of various materials, such as woods, for example. Spacer 10 has a support piece 12, with a top piece 14 extending outwardly from support piece 12. Top piece 14 has a break point 20. Top piece 14 is illustratively shown to have a ridge 16 extending downwardly from it as shown in FIG. 1. Support piece 12, top piece 14, and ridge 16 are configured to form hook 18. Support piece 12 is illustratively shown to have shelf piece 22 extending outwardly from it in a direction opposite to that which top piece 14 extends. Spacer 10 is illustratively shown as having a brace 24, which is connected to the shelf piece 22 and support piece 12. Shelf piece 22 illustratively has ridge 26, which extends upwardly from shelf piece 22 as shown in FIG. 1.

Figure 2:
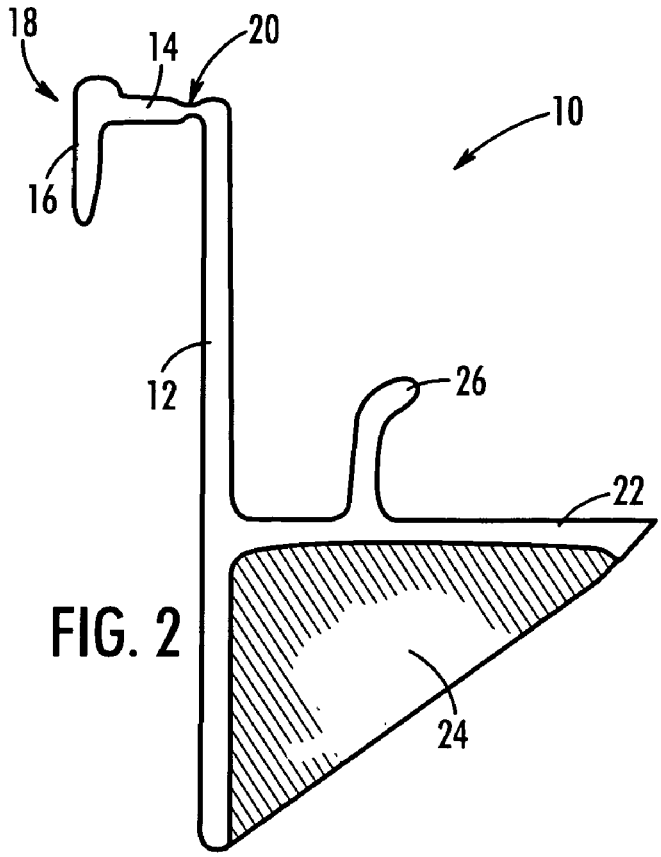
FIG. 2 is a side view of the illustrative embodiment of the spacer shown in FIG. 1.

A side view of an illustrative embodiment of spacer 10 is shown in FIG. 2. Break point 20 is illustratively shown to be made from a narrowing of a segment of top piece 14. Break point 20 allows spacer 10 to be separated at break point 20 when shelf piece 22 is struck with an object. (See, also, FIGS. 3C, 4.)

Figure 3C:
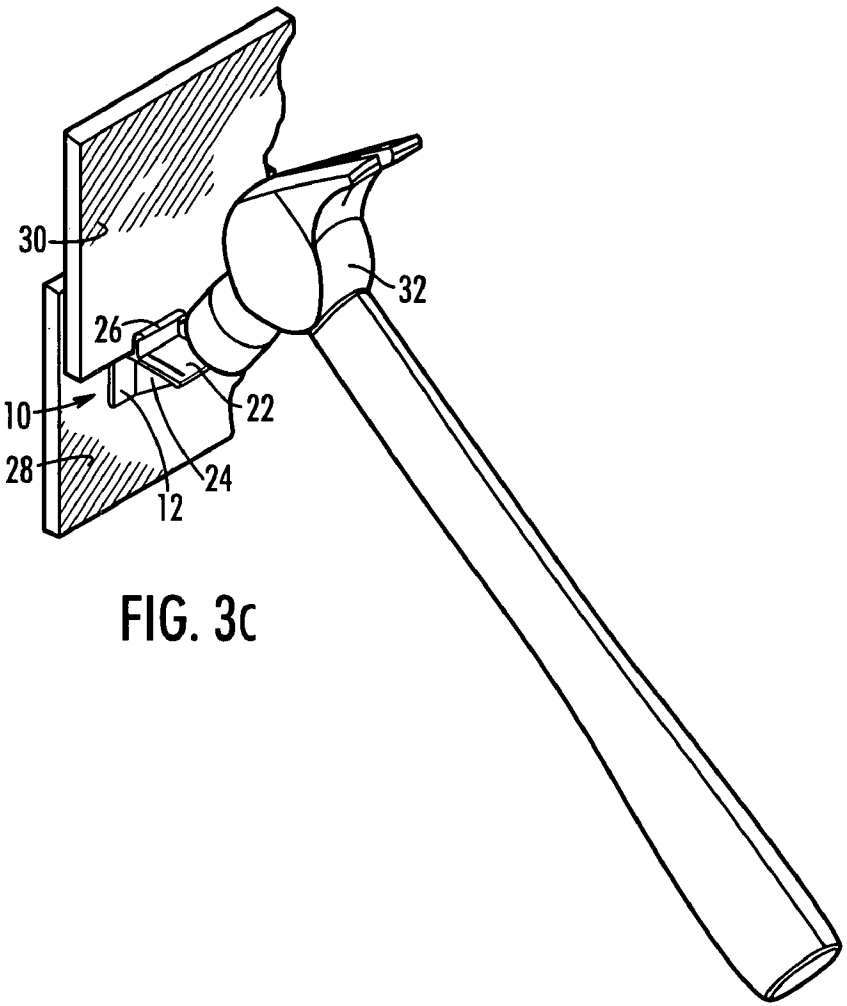
FIG. 3 is a perspective view showing a progression of an illustrative embodiment of a spacer being utilized with two fiber cement siding panel portions.
Figure 3B:
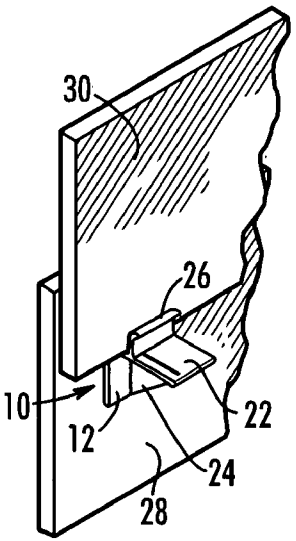
Figure 3A:
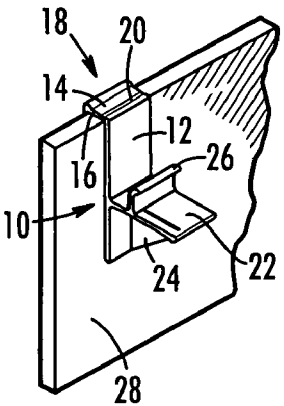

A perspective view showing a progression of spacer 10 being used to support a fiber cement siding panel 30 is illustratively shown in FIG. 3. This progression divides FIG. 3 into three stages, illustratively shown as FIGS. 3A, 3B, and 3C. Spacer 10 is illustratively shown as being attached to a portion of fiber cement siding panel 28 in FIG. 3A. Spacer 10 is illustratively attached to fiber cement siding panel 28 by hook 18. It is contemplated that fiber cement siding panel 28 is previously attached to a structure to be sided, with spacer 10 being attached to fiber cement siding panel 28 after fiber cement siding panel 28 has been attached to the structure to be sided.

With spacer 10 attached to fiber cement siding panel 28, another fiber cement siding panel 30 can be placed onto shelf piece 22 of spacer 10 as illustratively shown in FIG. 3B. Ridge 26 is illustratively shown to be positioned at a distance from support piece 12 such that the gap between ridge 26 and support piece 12 is wide enough to receive fiber cement siding panel 30. Ridge 26 extends from shelf piece 22 such that fiber cement siding panel 30 is prohibited from slipping along shelf piece 22 when fiber cement siding panel 30 is placed between ridge 26 and support piece 22. It is contemplated that once fiber cement siding panel 30 is placed onto shelf piece 22, fiber cement siding panel 30 is attached to the structure to be sided.

After fiber cement siding panel 30 is attached to the structure to be sided, a portion of spacer 10 may be removed by striking shelf piece 22 with an object, such as a hammer 32, for example, as illustratively shown in FIG. 3C. When hammer 32 strikes the portion of shelf piece 22 extending beyond ridge 26, spacer 10 separates into two parts at break point 20. (See, also, FIGS. 1–2, 3A.) This allows ridge 16 and a portion of top piece 14 to remain on fiber cement siding panel 28, with the remaining portion of spacer 10 being removable from the attachment with fiber cement siding panel 28. With the removable portion of spacer 10 gone, no portions of spacer 10 are seen when viewing fiber cement siding panels 28, 30 from the outside. Also, with the removable portion of spacer 10 gone, fiber cement siding panels 28, 30 come into at least one point of contact such that potential winds are kept from moving fiber cement siding panel 30 away from the structure to be sided.

It is contemplated that more than one spacer 10 may be used, depending on the length of each fiber cement siding panels, such as fiber cement siding panels 28, 30, for example. It is appreciated that at least two spacers 10 may be used to balance a fiber cement siding panel, allowing the fiber cement siding to be installed by only one individual.

Figure 4:
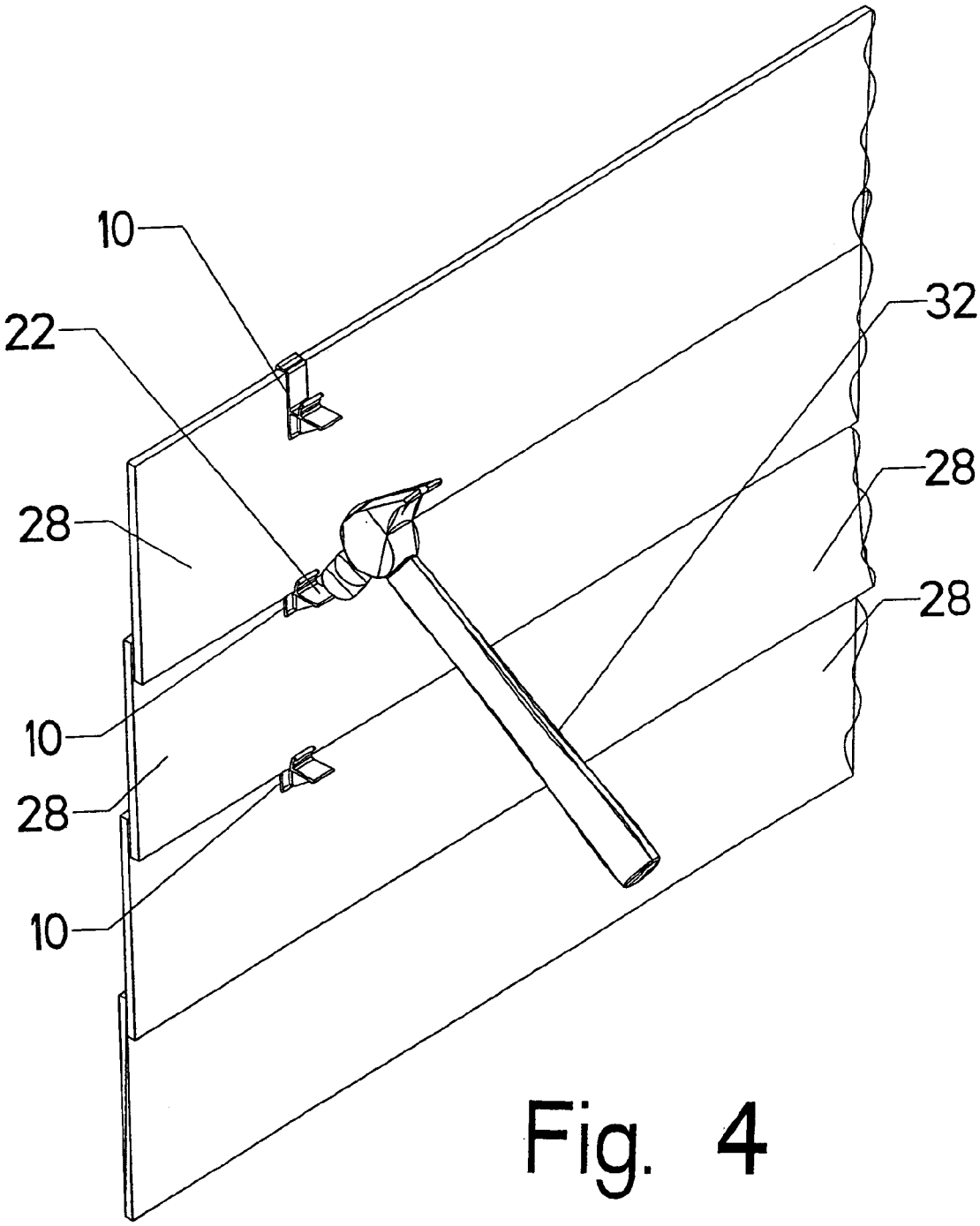
FIG. 4 is a perspective view of a plurality of spacers and a plurality of fiber cement siding panels.

A perspective view of a plurality of spacers 10, with a plurality of fiber cement siding panels 28, is illustratively shown in FIG. 4. Hammer 32 is illustratively shown to be striking a shelf piece 22 of a spacer 10, similar to that shown in FIG. 3C. This view also illustratively shows how the spacers 10 may be positioned with respect to the fiber cement siding panels 28.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A method for installing siding strips with a spacer having a hook portion and a shelf portion, said steps comprising:

(a) securing a first siding strip to a structure;

(b) positioning the hook portion of said spacer onto a first siding strip;

(c) placing a second siding strip onto the shelf portion of said spacer with said second siding strip overlapping said first siding strip;

(d) securing the second siding strip to the structure; and (e) separating said shelf portion of the spacer from said hook portion of the spacer, such that the first and second siding strips come into unobstructed contact with each other.

2. The method of claim 1, said shelf portion comprising:

(a) a positioning surface;

(b) a ridge; and (c) a striking surface;

(d) wherein, said ridge is disposed between said positioning surface and said striking surface.

3. The method of claim 2, further comprising the step of placing the second siding strip onto the positioning surface of said shelf portion.

4. The method of claim 3, further comprising the step of separating said shelf portion from said hook portion by striking said striking surface.

5. The method of claim 1, wherein step (e) includes applying force to an exposed portion of said spacer extending from said shelf portion to separate said shelf portion from said hook portion.

6. A spacer for use in installing siding panels, said spacer comprising:

a hook attachable to a first siding panel;

a shelf portion dimensioned to receive a second siding panel;

wherein said hook comprises a first wall, a second wall, and a third wall, wherein said first wall and said third wall extend from opposing ends of said second wall;

wherein said shelf portion comprises a fourth wall, a fifth wall, and said third wall, wherein said third wall and said fifth wall extend from opposing ends of said fourth wall; and wherein said hook includes a frangible portion configured to separate said shelf portion from said hook such that the first siding panel and the second siding panel come into unobstructed contact with each other.

7. The spacer of claim 6, wherein said third wall has a top end and a bottom end and wherein said frangible portion is adjacent said top end of said third wall.

8. The spacer of claim 7, wherein said fourth wall is adjacent said bottom end of said third wall.

9. The spacer of claim 8, wherein said fourth wall is dimensioned to carry said second siding panel.

10. The spacer of claim 7, wherein said frangible portion extends substantially along an entire dimension of said second wall.

11. The spacer of claim 10, wherein said frangible portion has a reduced thickness compared to surrounding portions of said second wall.

12. The spacer of claim 6, further comprising a tab extending from said shelf portion.

13. The spacer of claim 12, wherein said frangible portion is configured to release said third wall from said second wall responsive to force applied to said tab.

14. The spacer of claim 13, wherein said tab is integrally formed with said shelf portion and wherein said tab remains integral with said shelf portion upon release of said third wall from said second wall.

15. The spacer of claim 14, wherein said frangible portion separates said second wall from said third wall responsive to striking of said tab.

16. A spacer for use in installing siding panels, said spacer comprising:

a hook attachable to a first siding panel;

a shelf portion dimensioned to receive a second siding panel;

a tab extending from said shelf portion;

wherein said hook comprises a first wall, a second wall, and a third wall, wherein said first wall and said third wall extend from opposing ends of said second wall;

wherein said shelf portion comprises a fourth wall, a fifth wall, and said third wall, wherein said third wall and said fifth wall extend from opposing ends of said fourth wall; and wherein said second wall includes a frangible portion that is configured to release said third wall from said second wall responsive to force applied to said tab.

17. The spacer of claim 16, wherein said third wall has a top end and a bottom end and wherein said frangible portion is adjacent said top end of said third wall.

18. The spacer of claim 17, wherein said fourth wall is adjacent said bottom end of said third wall.

19. The spacer of claim 18, wherein said fourth wall is dimensioned to carry said second siding panel.

20. The spacer of claim 17, wherein said frangible portion extends substantially along an entire dimension of said second wall.

21. The spacer of claim 10, wherein said frangible portion has a reduced thickness compared to surrounding portions of said second wall.

22. The spacer of claim 16, wherein said tab is integrally formed with said shelf portion and wherein said tab remains integral with said shelf portion upon release of said third wall from said second wall.

23. The spacer of claim 22, wherein said frangible portion separates said second wall from said third wall responsive to striking of said tab.

24. A spacer for use in installing siding panels, said spacer comprising:

a hook attachable to a first siding panel;

a shelf portion dimensioned to receive a second siding panel;

a tab extending from said shelf portion;

wherein said hook comprises a first wall, a second wall, and a third wall, wherein said first wall and said third wall extend from said second wall in a substantially perpendicular manner;

wherein said shelf portion comprises a fourth wall, a fifth wall, and said third wall, wherein said third wall and said fifth wall extend from said fourth wall in a substantially perpendicular manner;

wherein said second wall includes a frangible portion;

wherein said third wall has a top end and a bottom end, wherein said frangible portion is adjacent said top end of said third wall and said fourth wall is adjacent said bottom end of said third wall;

wherein said frangible portion has a reduced thickness compared to surrounding portions of said second wall; and wherein said frangible portion is configured to release said third wall from said second wall responsive to force applied to said tab.

25. The spacer of claim 24, wherein said tab is integrally formed with said shelf portion and wherein said tab remains integral with said shelf portion upon release of said third wall from said second wall.

26. The spacer of claim 25, wherein said frangible portion separates said second wall from said third wall responsive to striking of said tab.

* * * * *